US008600255B2

(12) United States Patent
Miyahara

(10) Patent No.: US 8,600,255 B2
(45) Date of Patent: Dec. 3, 2013

(54) IMAGE FORMING DEVICE THAT PERFORMS REVERSE-TRANSFER OPERATION IN ACCORDANCE WITH IMAGE FORMING CONDITION

(75) Inventor: Kensuke Miyahara, Hekinan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 608 days.

(21) Appl. No.: 12/855,337

(22) Filed: Aug. 12, 2010

(65) Prior Publication Data

US 2011/0157613 A1 Jun. 30, 2011

(30) Foreign Application Priority Data

Dec. 25, 2009 (JP) ..... 2009-294147

(51) Int. Cl.
*G03G 15/00* (2006.01)

(52) U.S. Cl.
USPC ..... 399/71

(58) Field of Classification Search
USPC ..... 399/43, 44, 71, 123
See application file for complete search history.

(56) References Cited

U.S. PATENT DOCUMENTS

| | | | |
|---|---|---|---|
| 5,740,493 | A | 4/1998 | Otaki et al. |
| 7,274,889 | B2 | 9/2007 | Furukawa |
| 2008/0031649 | A1 | 2/2008 | Dan |
| 2008/0317506 | A1 | 12/2008 | Furukawa |
| 2010/0061744 | A1* | 3/2010 | Kim ..... 399/43 |

FOREIGN PATENT DOCUMENTS

| | | |
|---|---|---|
| JP | 2001-5360 | 1/2001 |
| JP | 2003-280335 | 10/2003 |
| JP | 2005-338205 | 12/2005 |
| JP | 2007-121657 | 5/2007 |
| JP | 2008-39905 | 2/2008 |
| JP | 2009-3377 | 1/2009 |

OTHER PUBLICATIONS

U.S. Office Action dated Aug. 17, 2012, received in related U.S. Appl. No. 12/855,315.
Office Action dated Jan. 22, 2013 received from the Japanese Patent Office from related Japanese Application No. 2009-294148 and U.S. Appl. No. 12/885,315, together with an English-language translation.
Office Action dated Jan. 22, 2013 received from the Japanese Patent Office from related Japanese Application No. 2009-294147, together with an English-language translation.

* cited by examiner

*Primary Examiner* — David Gray
*Assistant Examiner* — Andrew Do
(74) *Attorney, Agent, or Firm* — Scully, Scott, Murphy & Presser, PC

(57) ABSTRACT

An image forming device performs an image forming operation in either one of a color mode or a monochrome mode. The image forming device includes a plurality of photosensitive members, a plurality of collecting members configured to collect excrescences from the corresponding photosensitive members, and a reverse-transfer member that performs a reverse-transfer operation to transfer the excrescences collected by the collecting members back onto the photosensitive members and further onto an endless bearing member. A control unit controls the reverse-transfer member to perform the reverse-transfer operation at a frequency when image forming operations are performed in succession in the monochrome mode. The control unit sets the frequency based on an image forming condition.

14 Claims, 7 Drawing Sheets

FIG.6

| | | TEMPERATURE (℃) | | | | | |
|---|---|---|---|---|---|---|---|
| | | ~10 | ~15 | ~20 | ~25 | ~30 | 30~ |
| HUMIDITY(%) | ~10 | /60P | /60P | /60P | /60P | /60P | /30P |
| | ~20 | /60P | /60P | /60P | /60P | /30P | /30P |
| | ~30 | /60P | /60P | /60P | /30P | /30P | /10P |
| | ~40 | /60P | /60P | /60P | /30P | /10P | /5P |
| | ~50 | /60P | /30P | /30P | /30P | /5P | /5P |
| | ~60 | /30P | /30P | /10P | /10P | /5P | /1P |
| | ~70 | /30P | /10P | /5P | /5P | /5P | /1P |
| | ~80 | /10P | /10P | /5P | /5P | /1P | /1P |
| | ~90 | /10P | /5P | /5P | /1P | /1P | /1P |
| | ~100 | /5P | /5P | /5P | /1P | /1P | /1P |

IMAGE FORMING DEVICE THAT PERFORMS REVERSE-TRANSFER OPERATION IN ACCORDANCE WITH IMAGE FORMING CONDITION

CROSS REFERENCE TO RELATED APPLICATION

This application claims priority from Japanese Patent Application No. 2009-294147 filed Dec. 25, 2009. The entire content of this priority application is incorporated herein by reference.

TECHNICAL FIELD

The present invention relates to an image forming device, such as a color laser printer.

BACKGROUND

There has been provided a laser printer for forming color images. For example, a laser printer employing a direct-transfer method includes a plurality of photosensitive members for respective colors, and a developing unit having a plurality of developing rollers for forming toner images with toner of each color corresponding to respective electrostatic latent images on the photosensitive members. The toner images are transferred from the photosensitive members onto a printing sheet of paper conveyed on a conveying belt to form a color image.

Some type of laser printer has a color mode for forming color images and a monochrome mode for forming monochrome images only with black toner. In the monochrome mode, only a developing roller for black is placed in contact with a corresponding photosensitive member, and remaining developing rollers are kept out of contact with corresponding photosensitive members. In the color mode, on the other hand, all of the developing rollers are in contact with the corresponding photosensitive members.

Some of the toner supplied onto each photosensitive member may not be transferred onto the printing sheet and remains on the photosensitive member. Also, toner of reverse polarity once transferred onto a printing sheet from an upstream-side photosensitive member may be transferred from the printing sheet onto a downstream-side photosensitive member located downstream of the upstream-side photosensitive member in a sheet conveying direction. In order to remove such toner (residue toner) and other excrescence from the photosensitive member, a collecting roller may be provided for each photosensitive member.

Specifically, a predetermined bias is applied to each collecting roller to transfer the residue toner from the photosensitive member onto the collecting roller. Then, the residue toner collected onto the collecting roller is transferred back onto the photosensitive member and further onto the conveying belt. Thereafter, the residue toner is removed from the conveying belt with a cleaning member disposed in contact with the conveying belt.

SUMMARY

In the laser printer described above, an amount of residue toner temporarily held on each collecting roller increases as image forming operations are performed in succession. In this case, there is a danger that the collecting rollers cannot collect all reside toner from the photosensitive members. However, uncollected residue toner that remains on the photosensitive members without being collected by the collecting rollers can be collected onto the developing rollers in contact with the photosensitive members when the laser printer is in the color mode. Thus, such uncollected residue toner does not adversely affect printing results.

On the other hand, when the laser printer is in the monochrome mode, the developing rollers for the colors other than black are held out of contact with the photosensitive members and thus cannot collect residue toner. Therefore, if the image forming operations are performed in succession in the monochrome mode, uncollected residue toner accumulates on the photosensitive members for the colors other than black and adversely affects printing results.

In view of the foregoing, it is an object of the invention to provide an image forming device capable of desirably removing residue toner and other excrescence from photosensitive members.

In order to attain the above and other objects, the invention provides an image forming device that performs an image forming operation in either one of a color mode for forming a color image with developers of a plurality of colors including black and a monochrome mode for forming a monochrome image with black developer. The image forming device includes a plurality of photosensitive members for the respective colors, a plurality of developing rollers, an endless bearing member disposed in confrontation with the plurality of photosensitive members, a plurality of collecting members, a reverse-transfer member, and a control unit. Each developing roller is configured to supply the developer to the corresponding photosensitive member to form a visible image on the photosensitive member. Each collecting member is configured to collect excrescences from the corresponding photosensitive member, the excrescences clinging on the photosensitive members after the visible images are transferred away from the photosensitive members. The reverse-transfer member performs a reverse-transfer operation to transfer the excrescences collected by the collecting members back onto the photosensitive members and further onto the endless bearing member. The control unit is configured to control the reverse-transfer member to perform the reverse-transfer operation at a frequency when the image forming operations are performed in succession in the monochrome mode. The control unit sets the frequency based on an image forming condition.

BRIEF DESCRIPTION OF THE DRAWINGS

The particular features and advantages of the invention as well as other objects will become apparent from the following description taken in connection with the accompanying drawings, in which:

FIG. 6 is a view showing a data table according to the second embodiment of the invention.

DETAILED DESCRIPTION

Figure 1:
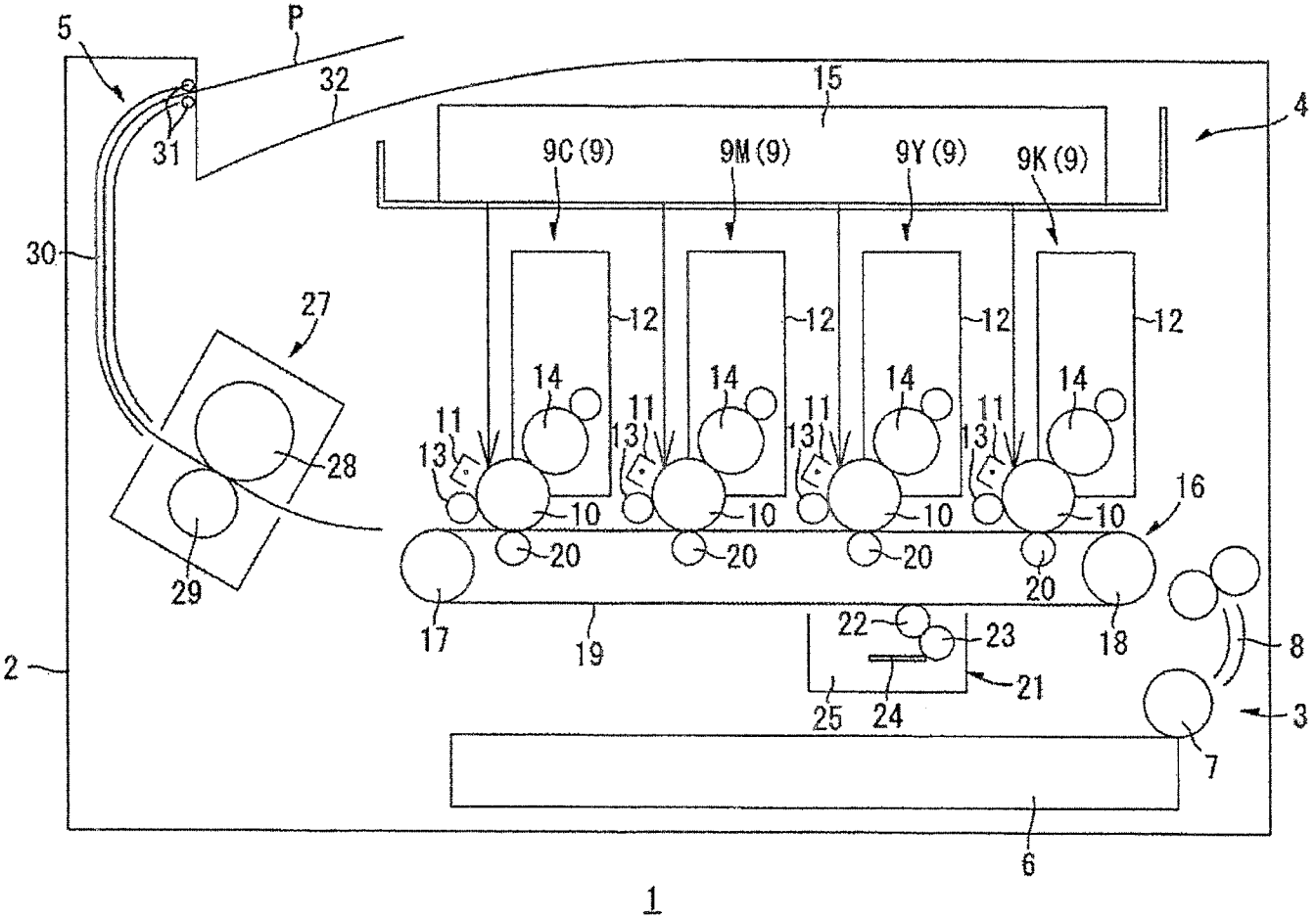
FIG. 1 is a cross-sectional side view showing the overall configuration of a color laser printer according to a first embodiment of the invention.

Image forming devices according to embodiments of the invention will be described while referring to the accompanying drawings wherein like parts and components are designated by the same reference numerals to avoid duplicating description. Note that the terms "upper," "lower," "beneath," and the like will be used throughout the description assuming that an image forming device is disposed in an orientation in which it is intended to be used. In use, the image forming device is disposed as shown in FIG. 1.

FIG. 1 shows a color laser printer 1 as an image forming device according to a first embodiment of the invention. The color laser printer 1 is a tandem-type color laser printer, and includes a box-shaped main casing 2 and, within the main casing 2, a sheet supply unit 3 for supplying a sheet P, an image forming unit 4 for forming images on the sheet P supplied from the sheet supply unit 3, and a discharge unit 5 for discharging the sheet P with images formed thereon.

The sheet supply unit 3 includes a supply tray 6 for storing a stack of sheets P and a feed roller 7 for feeding the sheets P stacked on the supply tray 6 one at a time. The sheet P fed by the feed roller 7 is conveyed along a sheet conveying path 8 toward the image forming unit 4.

The image forming unit 4 includes four process units 9, i.e., a black process unit 9K, a yellow process unit 9Y, a magenta process unit 9M, and a cyan process unit 9C arranged in this order in a sheet conveying direction of the sheet P.

Each process unit 9 includes a photosensitive drum 10 (photosensitive member), a charging unit 11, a developing unit 12, and a collecting member 13.

The photosensitive drum 10 is in a column shape and driven to rotate in a predetermined direction (a clockwise direction in FIG. 1) during an image forming operation. The charging unit 11 is a positive Scorotron charging unit, for example. The charging unit 11 includes a wire and a grid, and generates corona discharge when a charging bias is applied thereto.

The developing unit 12 is disposed on the downstream side of the charging unit 11 in the rotation direction of the photosensitive drum 10. The developing unit 12 accommodates toner (developer) of each color, and has a developing roller 14 for supplying the toner to the surface of the photosensitive drum 10. The developing roller 14 is disposed to extend along a center axis of the photosensitive drum 10 and to contact the surface of the photosensitive drum 10 with the peripheral surface thereof. During the image forming operation, a developing bias is applied to the developing roller 14.

The collecting member 13 is disposed on the upstream side of the charging unit 11 and downstream side of a conveying belt 19 (described later) in the rotation direction of the photosensitive drum 10. The collecting member 13 is disposed to extend along the center axis of the photosensitive drum 10 and to contact the surface of the photosensitive drum 10 with the peripheral surface thereof. A collecting bias is selectively applied to the collecting member 13 in a manner described later.

During the image forming operation (developing operation), the photosensitive drum 10 is driven to rotate in the predetermined direction. The corona discharge generated by the charging unit 11 uniformly charges the surface of the rotating photosensitive drum 10 with positive polarity. Then, the positively charged surface of the photosensitive drum 10 is exposed to high speed scanning of a laser beam emitted from an exposure unit 15. As a result, an electrostatic latent image corresponding to an image to be printed on the sheet P is formed on the surface of the photosensitive drum 10. Subsequently, the toner carried on the developing roller 14 is selectively supplied to the electrostatic latent image on the photosensitive drum 10. As a result, the electrostatic latent image is transformed into a visible toner image. In this manner, the toner image is formed on the photosensitive drum 10.

Note that the exposure unit 15 is configured of LED array. The exposure unit 15 may be provided to each process unit 9. Alternatively, the exposure unit 15 may be disposed above the image forming unit 4 as a scanner unit having a light source and a polygon mirror.

The color laser printer 1 also includes a transfer unit 16 disposed beneath the four process units 9 for transferring the toner images from the photosensitive drums 10 to the sheet P.

The transfer unit 16 (transfer member) includes a drive roller 17, a driven roller 18 disposed opposing with the drive roller 17 at a position upstream of the drive roller 17 in the sheet conveying direction, and the conveying belt 19 wound around and stretched between the drive roller 17 and the driven roller 18. The conveying belt 19 is an endless belt (endless bearing member).

The transfer unit 16 is disposed such that a top surface of an upper portion of the conveying belt 19 running between the top of the drive roller 17 and the top of the driven roller 18 contacts with the surfaces of the photosensitive drums 10. The drive roller 17 is driven by a driving force from a motor (not shown) to rotate in a direction (counterclockwise direction in FIG. 1) opposite to the rotation direction of the photosensitive drum 10. Rotation of the drive roller 17 circulates the conveying belt 19 in the same direction as the drive roller 17, which in turn rotates the driven roller 18.

The transfer unit 16 also includes four transfer rollers 20 and a cleaning unit 21. The transfer rollers 20 are disposed in confrontation with the corresponding photosensitive drums 10 with an upper portion of the conveying belt 19 interposed therebetween. The cleaning unit 21 is disposed in opposition to a lower part of the conveying belt 19.

The sheet P conveyed from the sheet supply unit 3 to the image forming unit 4 is supplied onto the conveying belt 19 and conveyed by the circulation of the conveying belt 19 to sequentially pass through nip points between the conveying belt 19 and the photosensitive drums 10 for the respective colors in the order of black, yellow, magenta, and cyan. At this time, a transfer bias applied to each transfer roller 20 transfers the toner image formed on each photosensitive drum 10 onto the sheet P. Any residual toner remaining on the photosensitive drums 10 after this transfer operation is electrostatically transferred onto the collecting members 13 when the residual toner comes into opposition to the collecting members 13. Thus transferred toner is accumulated on the collecting members 13 by electrostatic adsorption.

The cleaning unit 21 includes a primary cleaning roller 22, a secondary cleaning roller 23, an urethane blade 24, and a storage 25.

The primary cleaning roller 22 is disposed to extend horizontally in a direction orthogonal to the circulation direction of the conveying belt 19 and to contact the bottom surface of the lower part of the conveying belt 19 with the peripheral surface thereof. The primary cleaning roller 22 is driven to rotate in the same direction (counterclockwise direction in FIG. 1) as the circulation direction of the conveying belt 19. The secondary cleaning roller 23 is disposed to extend parallel to the primary cleaning roller 22 and contacts the peripheral surface of the primary cleaning roller 22.

The primary cleaning roller 22 and the secondary cleaning roller 23 are both applied with the cleaning biases to generate potential differences between the conveying belt 19 and the primary cleaning roller 22 and between the primary cleaning roller 22 and the secondary cleaning roller 23. The potential difference between the conveying belt 19 and the primary cleaning roller 22 transfers excrescences from the surface of the conveying belt 19 to the primary cleaning roller 22, and the potential difference between the primary cleaning roller 22 and the secondary cleaning roller 23 transfers the excrescences from the primary cleaning roller 22 to the secondary cleaning roller 23. Subsequently, the urethane blade 24 scrapes the excrescences from the secondary cleaning roller 23, and the excrescences are eventually collected into the storage 25.

The image forming unit 4 further includes a fixing unit 27 for fixing the toner images onto the sheet P. The fixing unit 27 includes a heat roller 28 and a pressure roller 29. When the sheet P passes through between the heat roller 28 and the pressure roller 29, the toner images transferred onto the sheet P are fixed onto the sheet P by heat and pressure. The sheet P discharged from the fixing unit 27 is then conveyed along a sheet conveying path 30 and discharged by discharge rollers 31 onto a discharge tray 32 formed on top of the main casing 2.

Figure 2:
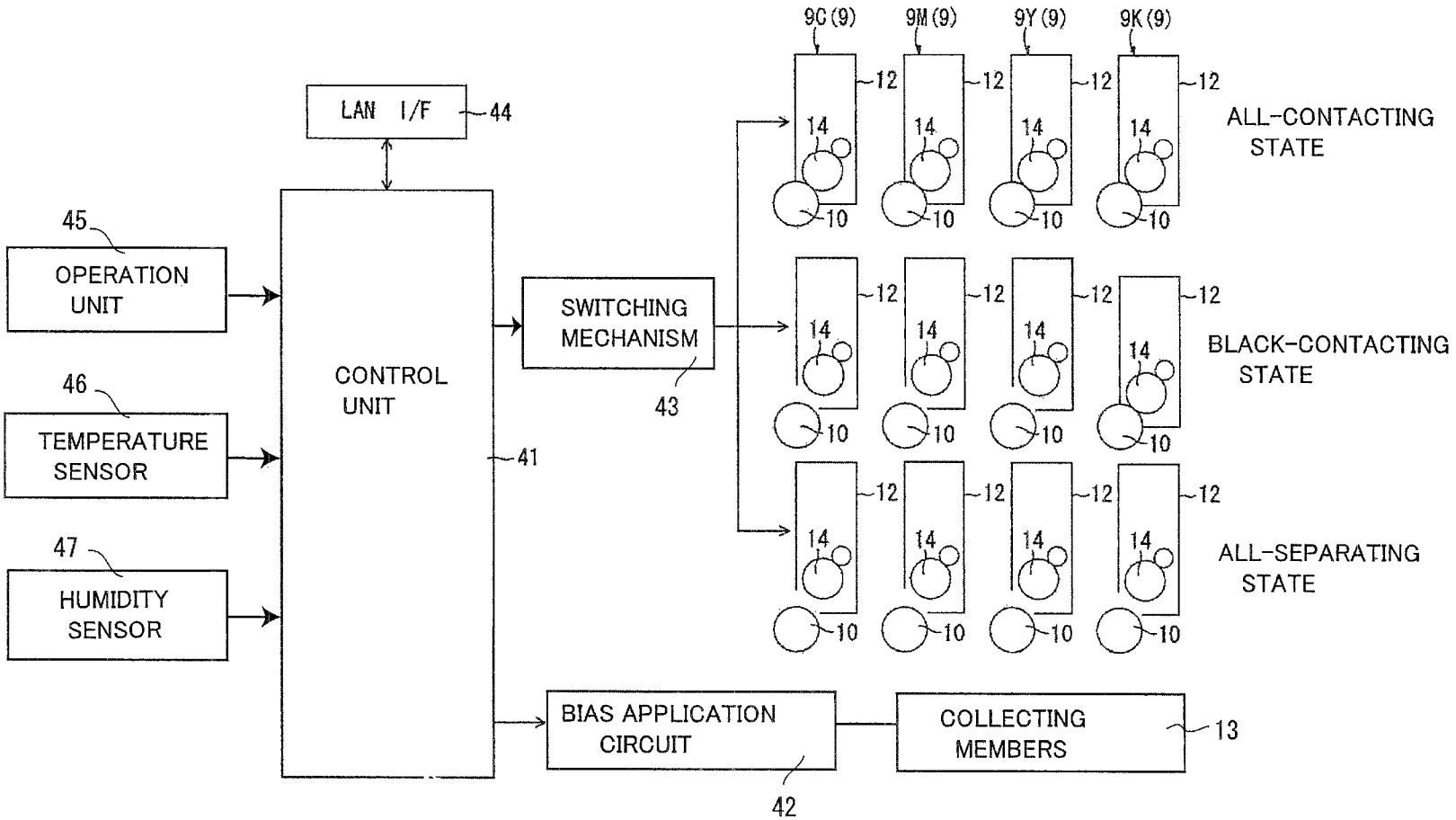
FIG. 2 is a block diagram showing relevant parts of the color laser printer of FIG. 1.

As shown in FIG. 2, the color laser printer 1 further includes a control unit 41, a bias application circuit 42, and a switching mechanism 43. The control unit 41 is a microcomputer including a CPU, a RAM, and a ROM (not shown). Both the bias application circuit 42 and the switching mechanism 43 are connected to the control unit 41 as controlled objects of the control unit 41.

The bias application circuit 42 is for selectively applying the collecting bias and a repelling bias of polarity opposite to the polarity of the collecting bias to each collecting member 13. Under the control of the control unit 41, the bias application circuit 42 can apply the collecting bias in the range between −500 V to +500 V to each collecting member 13.

More specifically, during the image forming operation, the control unit 41 controls the bias application circuit 42 to apply enough collecting bias to transfer excrescences, such as toner and the like, from the photosensitive drum 10 to the collecting member 13, and to apply the repelling bias to each collecting member 13 at a timing and frequency described later. The repelling bias applied to each collecting member 13 transfers the excrescences from the surface of the collecting member 13 back onto the corresponding photosensitive drum 10.

The excrescences transferred back onto the photosensitive drum 10 are brought into confrontation with the conveying belt 19 by the rotation of the photosensitive drum 10, transferred onto the conveying belt 19, and then collected by the primary cleaning roller 22 as described above. Hereinafter, a process to transfer the excrescences back onto the photosensitive drum 10 and further to the conveying belt 19 as described above will be hereinafter referred to as a reverse-transfer operation.

In this embodiment, each developing unit 12 is positioned so as to be movable relative to the corresponding photosensitive drum 10.

The switching mechanism 43 is for setting a contact state of the developing rollers 14 with respect to the photosensitive drums 10 in a method well-known in the art. More specifically, under the control of the control unit 41, the switching mechanism 43 sets the contact state to one of an all-separating state, a black-contacting state, and an all-contacting state. In the all-separating state, all of the four developing rollers 14 are out of contact with the corresponding photosensitive drums 10. In the black-contacting state, only the developing roller 14 for black is in contact with the photosensitive drum 10 of the black process unit 9K, and the remaining three developing rollers 14 are out of contact with the corresponding photosensitive drums 10. In the all-contacting state, all of the four developing rollers 14 are in contact with the corresponding photosensitive drums 10.

The control unit 41 controls the switching mechanism 43 to set the contact state to the black-contacting state when images are to be formed only with black toner, and to the all-contacting state when images are to be formed with toner of all colors.

The color laser printer 1 also includes a local area network interface (LAN I/F) 44 connected to the control unit 41 for connection to a LAN. The control unit 41 receives print data (image data) and the like from a personal computer connected to the LAN, for example, through the LAN I/F 44, and controls each of the above-mentioned components to form either color images or monochrome images on the sheet P based on the print data.

The color laser printer 1 further includes an operation unit 45 (selecting unit), a temperature sensor 46, and a humidity sensor 47, each connected to the control unit 41 as a controlled object of the control unit 41. The operation unit 45 is disposed on the main casing 2 for enabling a user to input various commands to the control unit 41. In this embodiment, a user can manipulate the operation unit 45 and set a print mode to either a normal print mode for forming images on a sheet of plain paper or a postcard print mode for forming images on a postcard. The control unit 41 sets conditions of components of the image forming unit 4 in accordance with the print mode, which has been selected by the user, i.e., in accordance with the type of sheet P, so as to produce preferable print results.

Also, the user can manipulate the operation unit 45 and select either a monochrome mode for printing monochrome images only with the black process unit 9K for black toner or a color mode for printing color images with all of the four process units 9.

The temperature sensor 46 and the humidity sensor 47 are well-known sensors for detecting temperature and humidity, respectively, within the main casing 2. The temperature sensor 46 and the humidity sensor 47 output respective detection results to the control unit 41, and the control unit 41 controls each component based on the detection results.

Next, a first control process according to the present embodiment will be described with reference to the flowchart of FIG. 3. The first control process is executed by the control unit 41 upon receiving print data from the personal computer through the LAN I/F 44.

Figure 3:
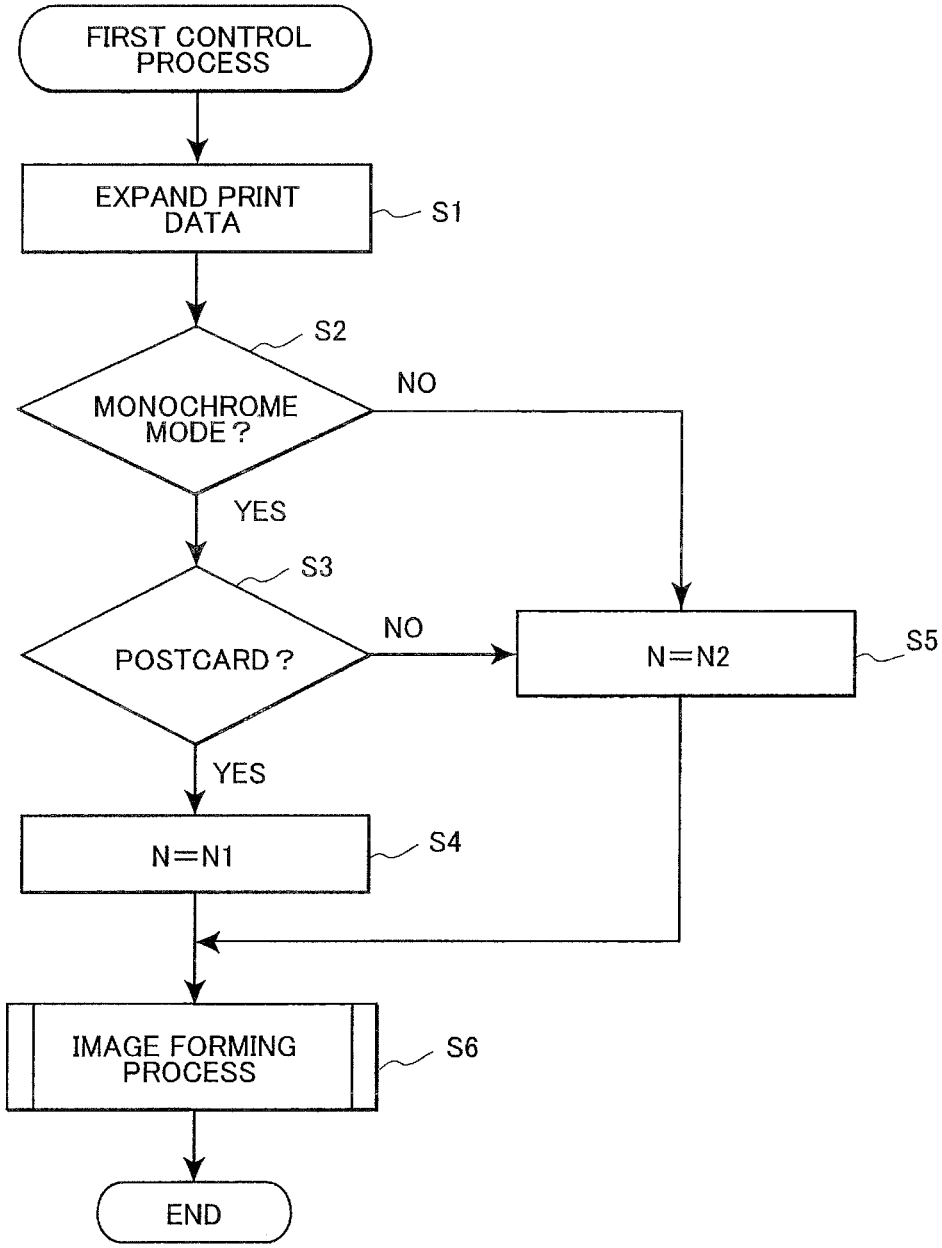
FIG. 3 is a flowchart representing a first control process according to the first embodiment of the invention.

In the process of FIG. 3, first in S1, the control unit 41 expands the print data in the RAM. Then, in S2 to S5, the control unit 41 sets a number of sheets as a frequency N in accordance with modes selected by the user. The frequency N is a frequency at which the reverse-transfer operation is performed when image forming operations are performed on a plurality of sheets P in succession.

Specifically, in S2, the control unit 41 determines whether the monochrome mode has been selected. If so (S2:Yes), then in S3 the control unit 41 determines whether the print mode is set to the postcard print mode. If so (S3:Yes), then in S4 the control unit 41 sets the frequency N to a first frequency N1 and stores the same into the RAM. Then, the control unit 41 proceeds to S6. In this embodiment, the first frequency N1 is 30, which means that the reverse-transfer operation is performed once every time the image forming operations are performed on 30 sheets P.

On the other hand, if a negative determination is made in S2 or S3 (S2:No or S3:No), then the control unit 41 proceeds to S5 and sets the frequency N to a second frequency N2 differing from the first frequency N1, and proceeds to S6. In the embodiment, the second frequency N2 is 60, which means that the reverse-transfer operation is performed once every time the image forming operations are performed on 60 sheets P. That is, the reverse-transfer operation is performed more often in the postcard print mode than in the normal print mode.

In S6, the control unit 41 executes an image forming process based on the print data, and ends the first control process.

The image forming process executed in S6 will be described with reference to the flowchart of FIG. 4. In the following explanation, it is assumed that the postcard print mode and the monochrome mode have been selected by the user, and that the frequency N has been set to the first frequency N1, i.e., 30. It is also assumed that 100 postcards are to be printed in succession.

Figure 4:
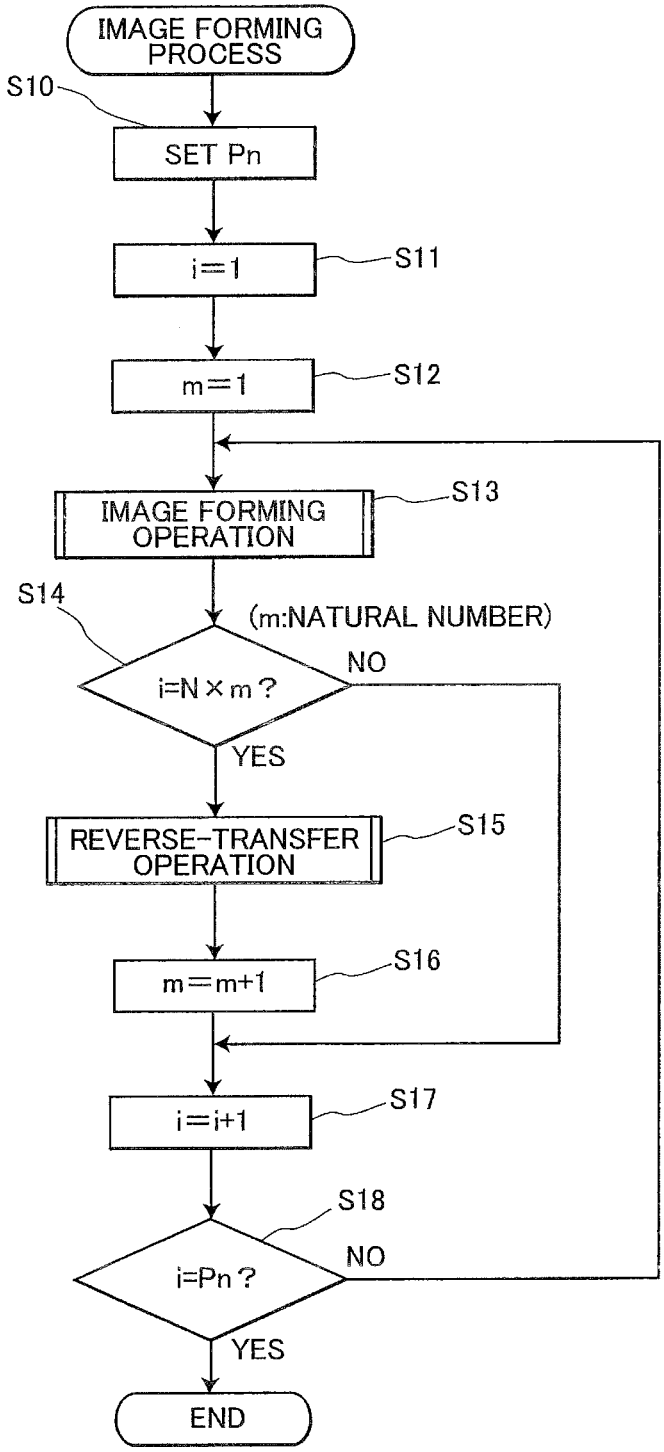
FIG. 4 is a flowchart representing an image forming process according to the first embodiment of the invention.

As shown in FIG. 4, first in S10, the control unit 41 sets Pn to a number of sheets P to be printed. In this example, 100 postcards are to be printed, so Pn is set to 100 in S10. Then, the control unit 41 sets a counter i to 1 in S11, and sets a counter m to 1 in S12. In S13, the control unit 41 controls the switching mechanism 43 to set the contact state to the black-contacting state, i.e., to set only the developing roller 14 of the black process unit 9K to contact the corresponding photosensitive drum 10 (or maintains the black-contact state if the contact state has already been set to the black-contact state), and executes the image forming operation on a single postcard as the sheet P. Note that, during the image forming operation, the collecting bias is applied to each collecting member 13, and each collecting member 13 collects excrescences from the corresponding photosensitive drum 10.

After printing on the single postcard, the control unit 41 determines in S14 whether or not the counter i equals the product of N times m, wherein N is N1=30 in this example. If not (S14:No), then the control unit 41 directly proceeds to S17 and increments the value of the counter i by 1. Next in S18 the control unit 41 determines whether or not the counter i has reached Pn which is 100 in this example. If so (S18:Yes), then the control unit 41 ends the image forming process. On the other hand, if not (S18:No), then the control unit 41 returns to S13 to perform the image forming operation on a next sheet P.

If a positive determination is made in S14 (S14:Yes), then in S15 the control unit 41 controls the switching mechanism 43 to set the contact state to the all-separating state and performs the reverse-transfer operation. Specifically, the control unit 41 controls the bias application circuit 42 to apply the repelling bias to each of the collecting members 13, thereby transferring excrescences once collected on the surfaces of the collecting members 13 back onto the photosensitive drums 10.

For example, the repelling bias is applied to the collecting member 13 of the black process unit 9K at a timing after a part of the surface of the photosensitive drum 10 of the black process unit 9K located on the downstream side of a region thereof where a trailing edge of a toner image is to be formed with respect to the rotation direction of the photosensitive drum 10 is past a contact point between the photosensitive drum 10 and the collecting member 13. Then, application of the repelling bias is halted by the time a leading edge of a next toner image formed on the photosensitive drum 10 reaches the contact point between the photosensitive drum 10 and the collecting member 13.

Then, the excrescences are transferred onto the conveying belt 19 when brought into confrontation with the conveying belt 19, and then collected by the primary cleaning roller 22. Transferring the excrescences back onto the photosensitive drums 10 at the timing described above enables to transfer the excrescences from each photosensitive drum 10 onto the conveying belt 19 in a sheet interval (medium interval), i.e., at a timing between when $i^{th}$ sheet P formed with a toner image is past the nip point between the photosensitive drum 10 and the conveying belt 19 and when $i+1^{th}$ sheet P on which a next toner image is to be formed reaches the nip point.

After the reverse-transfer operation completes, the control unit 41 also controls in S15 the switching mechanism 43 to set the contact state back to the black-contacting state.

Then, in S16, the control unit 41 increments the counter m by 1, and proceeds to S17. Thus, in this example, the reverse transfer operation is executed after the image forming operation is executed for $30^{th}$ sheet P, $60^{th}$ sheet P, and $90^{th}$ sheet P.

As described above, according to the present embodiment, the frequency of the reverse-transfer operation is changed so that the reverse-transfer operation is performed at a suitable timing to prevent an excessive amount of excrescences from accumulating on the collecting members 13 for the colors other than black when the image forming operations are performed in succession in the monochrome mode. Thus, it is possible to prevent degradation in collecting capability of each collecting member 13 and thus to prevent any excrescences from undesirably clinging onto the sheet P when the image forming operations are performed in succession in the monochrome mode.

Also, according to the present embodiment, the frequency of the reverse-transfer operation is changed depending on whether the sheet P is a plain paper or a postcard. Because the frequency is changed depending on the type of the sheet P, it is possible to perform the reverse-transfer operation at a timing appropriate for the type of sheet P. For example, toner is more likely remains on the photosensitive drum 10 without being transferred onto the sheet P when the sheet P is a postcard than when the sheet P is a plain paper. However, according to the present embodiment, the frequency is set higher for the postcard than for the plain paper. Thus, it is possible to perform the reverse-transfer operation at a suitable timing to prevent excrescences from clinging even on the postcard as the sheet P.

Further, because the user operates the operation unit 45 and selects desired one of the print modes, the user can select image forming conditions. This improves operability of the color laser printer 1.

Next, a color laser printer according to a second embodiment of the invention will be described. The color laser printer of this embodiment is identical to the color laser printer 1 of the above-described first embodiment, but differs in executing a second control process shown in FIG. 5 instead of the first control process shown in FIG. 3.

Figure 5:
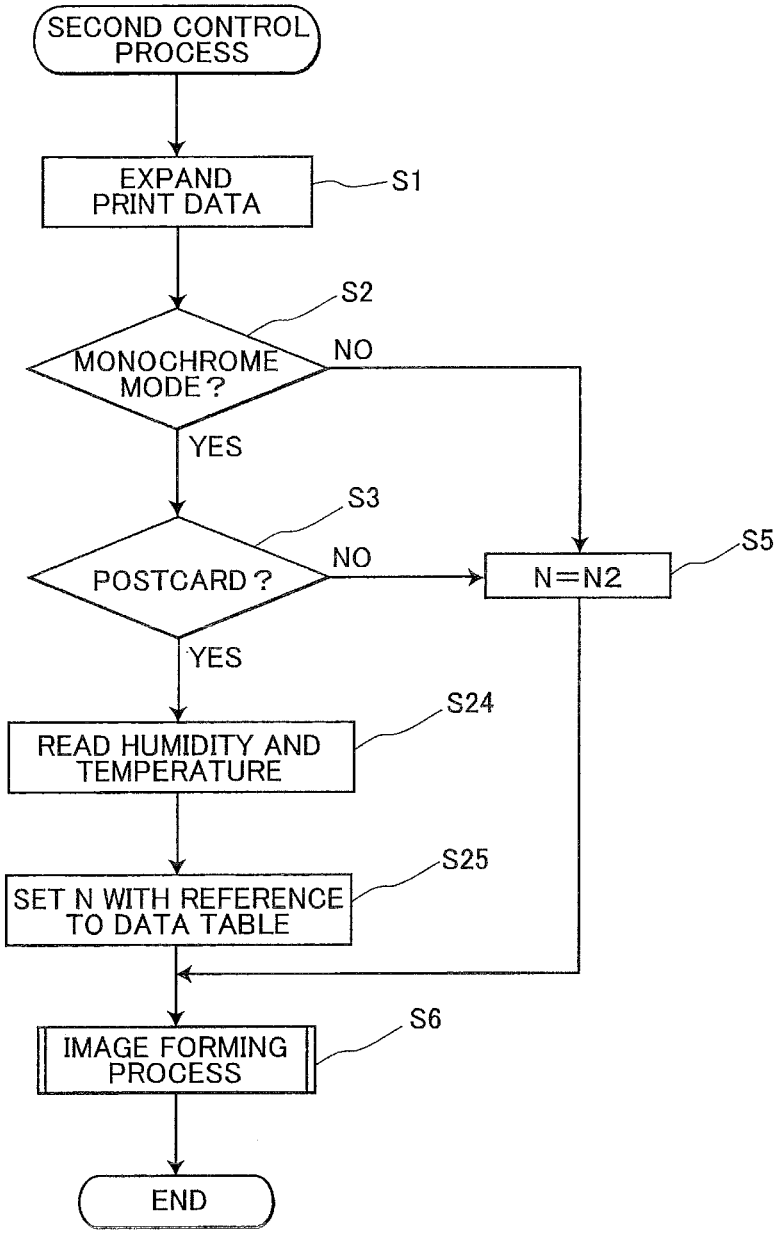
FIG. 5 is a flowchart representing a second control process according to a second embodiment of the invention.

Specifically, the processes in S1 to S3, and S5 of the second control process shown in FIG. 5 are identical to those of the first control process shown in FIG. 3. However, in the second control process of this embodiment, when a positive determination is made in S3 (S3:Yes), then in S24 the control unit 41 reads detection signals from the temperature sensor 46 and the humidity sensor 47. Then, in S25, the control unit 41 refers to a data table shown in FIG. 6 and determines the frequency N based on the temperature and the humidity indicated by the detection signals read in S24.

The data table is stored in the ROM of the control unit 41 and indicates a suitable frequency for each of various combinations of humidity and temperature for postcard printing.

The data table is set such that the frequency is set higher when the temperature or humidity is lower and set lower when the temperature or humidity is higher. For example, when the humidity is 20% and the temperature is 13 V, then the control unit 41 sets the frequency N to 60 so that the reverse-transfer operation is performed once every time the image forming operations are performed on 60 postcards. However, when the humidity is 95% and the temperature is 28 V (i.e., in a condition of high temperature and humidity), then the control unit 41 sets the frequency N to 1 so that the reverse-transfer operation is performed once every time the image forming operation is performed on a single postcard. When the humidity is 10% or more but less than 20% and the temperature is 20 V or more but less than 25 V, then the control unit 41 sets the frequency N to 60 so that the reverse-transfer operation is performed once every time the image forming operations are performed on 60 postcards.

After the control unit 41 sets the frequency N in S24 as described above, then the control unit 41 performs in S6 the image forming process shown in FIG. 4, and ends the second control process.

Because the frequency of the reverse-transfer operation is set in accordance with such ambient conditions as humidity and temperature, the reverse-transfer operation is performed at a frequency optimal for the ambient conditions. Thus, even if an amount of excrescences that cling on each photosensitive drum 10 after the transfer operation varies depending on the ambient conditions, it is possible to prevent the collecting members 13 from degrading in collecting capabilities thereof regardless of the sheet type.

Also, because the frequency is set higher in a humid or hot condition than in less humid or lower-temperature condition, the reverse-transfer operation is performed at an optimal frequency depending on the humidity and temperature.

Note that the frequency N may be determined based on the humidity and the temperature in the normal print mode also.

While the invention has been described in detail with reference to the embodiments thereof, it would be apparent to those skilled in the art that various changes and modifications may be made therein without departing from the spirit of the invention.

For example, during the reverse-transfer operation in the monochrome mode, the control unit 41 may control the switching mechanism 43 to maintain the developing roller 14 of the black process unit 9K in contact with the corresponding photosensitive drum 10 (i.e., maintain the black-contacting state). In this case, the reverse-transfer operation is performed while the developing roller 14 stays in contact with the photosensitive drum 10 as in the image forming operations, so it would not be necessary to perform a process to switch the developing roller 14 between a contact condition and a non-contact condition with respect to the photosensitive drum 10. Thus, the image forming operation can be quickly restarted after the reverse-transfer operation. This increases the speed of the image forming processes in the monochrome mode when performed in succession.

Figure 7:
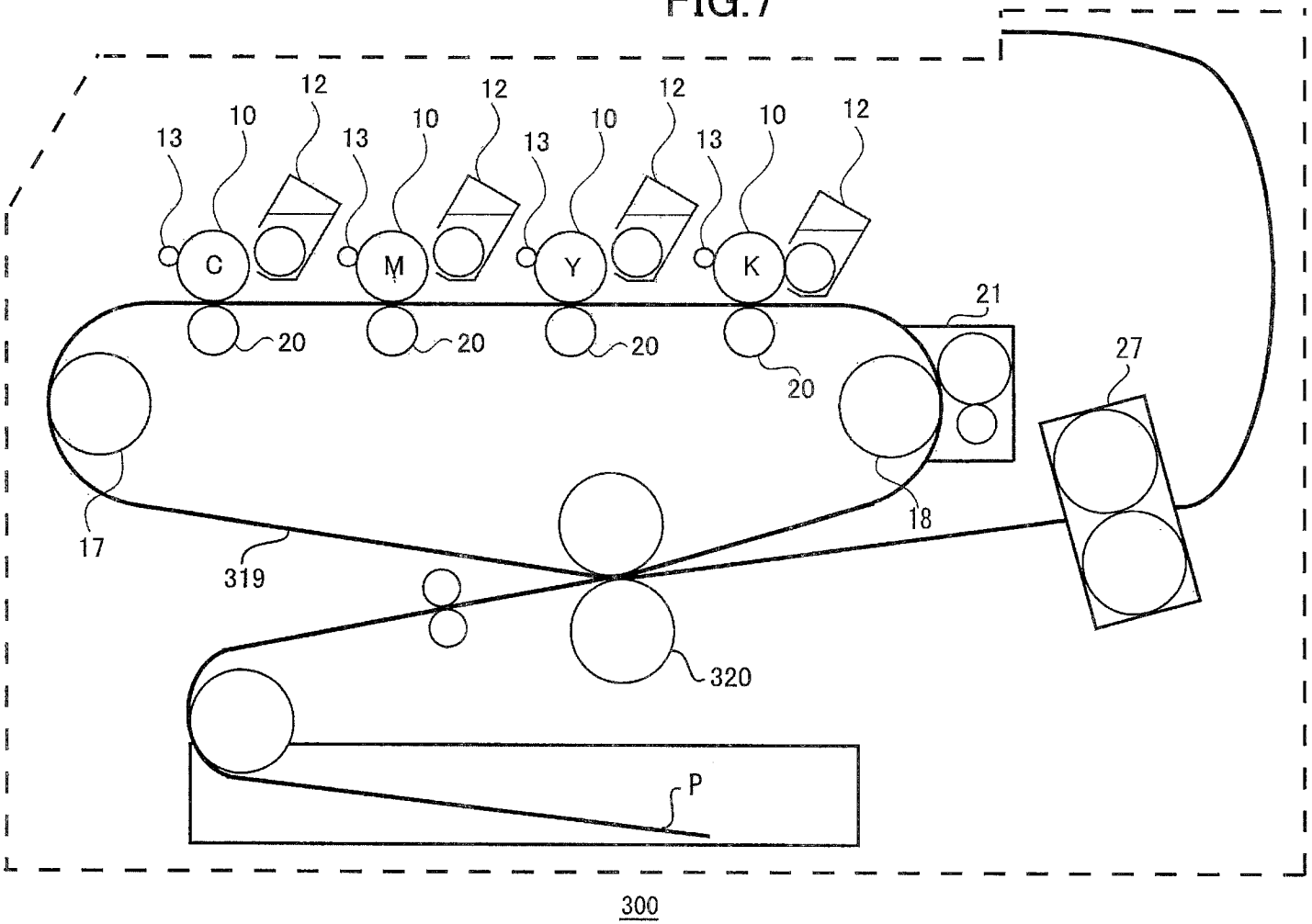
FIG. 7 is an explanatory side view of a color laser printer according to a modification of either the first or second embodiment of the invention.

Also, the present invention may also be applied to a color laser printer including an intermediate transfer member. More specifically, a color laser printer 300 shown in FIG. 7 includes an intermediate transfer belt 319 (endless bearing member). The toner images formed on the respective photosensitive drums 10 are once transferred onto the intermediate transfer belt 319, and then transferred onto the sheet P by a transfer roller 320 when the sheet P passes between a nip point between the intermediate transfer belt 319 and the transfer roller 320. The cleaning unit 21 is configured to clean the intermediate transfer belt 319. In this configuration, the reverse-transfer operation is performed such that the excrescences transferred back onto the photosensitive drums 10 are transferred onto the intermediate transfer belt 319 in a sheet interval, i.e., between when toner images to be transferred onto a sheet P are transferred from the photosensitive drums 10 onto the intermediate transfer belt 319 and when next toner images to be transferred onto a next sheet P are transferred from the photosensitive drums 10 onto the intermediate transfer belt 319.

What is claimed is:

1. An image forming device that performs an image forming operation in either one of a color mode for forming a color image with developers of a plurality of colors including black and a monochrome mode for forming a monochrome image with black developer, comprising:

a plurality of photosensitive members for the respective colors;

a plurality of developing rollers, each configured to supply the developer to the corresponding photosensitive member to form a visible image on the photosensitive member;

an endless bearing member disposed in confrontation with the plurality of photosensitive members;

a plurality of collecting members, each configured to collect excrescences from the corresponding photosensitive member, the excrescences clinging on the photosensitive members after the visible images are transferred away from the photosensitive members;

a reverse-transfer member that performs a reverse-transfer operation to transfer the excrescences collected by the collecting members back onto the photosensitive members and further onto the endless bearing member; and a control unit configured to control the reverse-transfer member to perform the reverse-transfer operation at a frequency when the image forming operations are performed in succession in the monochrome mode, the control unit setting the frequency based on an image forming condition.

2. The image forming device according to claim 1, further comprising:

a cleaning member configured to clean the endless bearing member; and a switching member that switches contact conditions such that all of the developing rollers are in contact with the corresponding photosensitive members in the color mode and that only one of the developing rollers corresponding to black is in contact with the corresponding photosensitive member in the monochrome mode.

3. The image forming device according to claim 2, wherein the switching member switches the contact conditions such that only the one of the developing rollers corresponding to black is in contact with the corresponding photosensitive member during the reverse-transfer operation in the monochrome mode.

4. The image forming device according to claim 1, wherein the image forming condition is a type of recording medium, and the control unit sets the frequency based on the type of recording medium.

5. The image forming device according to claim 4, wherein the control unit sets the frequency to a first frequency when the recording medium is a plain paper and to a second frequency higher than the first frequency when the recording medium is a postcard.

6. The image forming device according to claim 5, wherein the second frequency is such that the reverse-transfer operation is performed once each time the image forming operations are performed on 30 recording media.

7. The image forming device according to claim 1, wherein the image-forming condition is an ambient condition, and the control unit sets the frequency based on the ambient condition.

8. The image forming device according to claim 7, wherein the control unit sets the frequency to a higher frequency in conditions of higher ambient temperature and humidity than in conditions of lower ambient temperature and humidity.

9. The image forming device according to claim 8, wherein in conditions of relatively-high ambient temperature and humidity, the control unit sets the frequency such that the reverse-transfer operation is performed once each time the image forming operation is performed on a single recording medium.

10. The image forming device according to claim 1, further comprising a selecting unit enabling a user to select the image forming condition, wherein the control unit sets the frequency depending on the image forming condition selected by the user.

11. The image forming device according to claim 1, wherein the control unit controls the reverse-transfer member to perform the reverse-transfer operation in a medium interval.

12. The image forming device according to claim 1, wherein the control unit counts a number of times that the image forming operation is performed and controls the reverse-transfer member to perform the reverse-transfer operation when the control unit has counted a predetermined number corresponding to the frequency.

13. The image forming device according to claim 1, wherein the endless bearing member is an endless belt that conveys a recording medium onto which the visible images are transferred from the photosensitive members.

14. The image forming device according to claim 1, wherein the endless bearing member is an intermediate transfer belt onto which the visible images are transferred from the photosensitive members.

* * * * *